United States Patent [19]

Forgo et al.

[11] 4,181,422

[45] Jan. 1, 1980

[54] PROCESS AND APPARATUS FOR DEVELOPING AND CLEANING A CHARGE IMAGE CARRIER

[75] Inventors: Gabor Forgo, Zurich; Karl Moser, Forch, both of Switzerland

[73] Assignee: Elfotec A.G., Zumikon, Switzerland

[21] Appl. No.: 796,600

[22] Filed: May 13, 1977

[30] Foreign Application Priority Data

May 17, 1976 [DE] Fed. Rep. of Germany ..... 2621912

[51] Int. Cl.[2] ..... 355 15; G03G 15/09; G03G 21/00

[52] U.S. Cl. ..... 355/3 DD; 118/657

[58] Field of Search ..... 118/638, 657, 658; 355/3 DD, 15

[56] References Cited

U.S. PATENT DOCUMENTS

| | | | |
|---|---|---|---|
| 3,587,521 | 6/1971 | Rubenstein et al. | 118/658 X |
| 3,637,306 | 1/1972 | Cooper | 355/15 |
| 3,909,258 | 9/1975 | Kotz | 118/638 X |
| 3,952,701 | 4/1976 | Yamashita et al. | 118/658 |
| 4,067,296 | 1/1978 | Sessink | 355/3 DD |
| 4,081,571 | 3/1978 | Nishihama et al. | 355/3 DD |

OTHER PUBLICATIONS

Hoekzema, "Magnet Configuration for Magnetic Brush Developer", IBM TDB, vol. 14, No. 9, Feb. 1972, pp. 2787–2788.

*Primary Examiner*—A. D. Pellinen

*Attorney, Agent, or Firm*—Arnstein, Gluck, Weitzenfeld & Minow

[57] ABSTRACT

A process for developing a latent charge image on a repeatedly usable charge image carrier and for cleaning the carrier after transfer of the developed charge image by means of a single magnetic brush having a layer of magnetic one-component toner and a thickening of the layer of toner in the region of contact of the magnetic brush with the charge image carrier.

6 Claims, 3 Drawing Figures

PROCESS AND APPARATUS FOR DEVELOPING AND CLEANING A CHARGE IMAGE CARRIER

This invention relates to a process for the development of a latent electrostatic charge image on a repeatedly usable charge image carrier and for cleaning the carrier after transfer of the charge image which has been developed thereon to another image support, and also relates to an apparatus for carrying out the process.

It is known to produce a latent electrostatic charge image of an original on a repeatedly usable charge image carrier, for example a photoconductor containing zinc oxide as a photoconductive material, and to develop this charge image on the charge image carrier by means of a magnetic brush. When the toner image has been developed on the carrier, it can be transferred to a final image support, for example a sheet of paper, by means, such as a corona transfer process.

It is well known that in such a process residues of toner which have not been transferred from the charge image carrier to the final image support in the course of the transfer process must be removed from the charge image carrier. In other words, the charge image carrier must be thoroughly cleaned to remove residues of toner after each production of an image or at least after each change of the image original following the stage of image transfer so that it can be used again for image production.

Electrostatic copying machines are known which operate by the above mentioned process. The known machines which operate by the process mentioned above have the disadvantage of being relatively complicated, particularly with regard to the cleaning process, and they require frequent servicing. In particular, it has been found that in the known processes and apparatus which operate with two-component toners, it is difficult to maintain an optimum toner composition.

Apparatuses are already known, for example those disclosed in U.S. Pat. No. 3,829,208, in which a charge image carrier is taken from a supply roll in the interior of a drum, pulled over the circumferential surface of the said drum and carried away from the drum over a guide system after passing almost once round the circumference of the drum. The various devices normally used in electrostatic copying machines, for example a corona charging device, an exposure device, a magnetic brush for developing the latent charge image, a transfer device for transferring the developed image to a final image support and a device for cleaning the charge image carrier are distributed around the circumference of this drum.

Another known apparatus (see U.S. Pat. No. 3,588,242) also comprises a charge image carrier carried over the surface of the drum, but in this case the charge image carrier is taken from a supply roll situated in the interior of the said drum, and after travelling over the circumference of the drum the carrier is rolled up on a take-up roll also situated in the interior of the drum.

In apparatuses of this type, it is very important to ensure not only perfect development of the charge image produced on the charge image carrier but also a high standard of cleaning of the repeatedly usable charge image carrier after transfer of the charge image which has been developed therein to another, final image support, for example a sheet of paper. The reason for this is that when an image is transferred, for example by the known toner transfer process, a considerable amount of the toner which has been transferred to the charge image support for the purpose of developing the charge image is left on the image carrier and adheres to it. This quantity of residual toner may be as much as 30% of the total quantity of toner deposited on the charge image carrier for the purpose of developing the charge image.

The efficiency of the cleaning device for the repeatedly usable charge image carrier is therefore of major importance. It is already known to use a magnetic brush for cleaning the charge image carrier. In practice, however, it has been found that this does not give sufficiently thorough cleaning. Moreover, to obtain results of any reasonably acceptable standard it is necessary to provide relatively complicated apparatus and employ special measures such as, for example, the application of various potentials to the cleaning agents and the provision of additional brushes.

It is therefore an object of the present invention to provide a process for developing a latent electrostatic charge image on a repeatedly usable charge image carrier and for cleaning the charge image carrier after the image which has been developed on it has been transferred to a final image support, which process is simple and reliable, and to provide for carrying out the process a constructionally simple apparatus which requires only a small amount of maintenance.

According to the invention there is provided a process for developing a latent electric charge image on a repeatedly usable charge image carrier and for cleaning the repeatedly usable charge image carrier after transfer of the charge image which has been developed on the repeatedly usable charge image carrier, wherein both development of the latent charge image and cleaning of the repeatedly usable charge image carrier after transfer of the charge image developed on it are effected by means of applying a layer of a magnetic one-component toner on a single magnetic brush, the layer on the magnetic brush forming a thickening in the region of contact of the magnetic brush with the charge image carrier.

The invention also provides an apparatus for developing a latent electric charge image on a repeatedly usable charge image carrier and for cleaning the repeatedly usable charge image carrier after transfer of the charge image which has been developed on the repeatedly usable charge image carrier, comprising a single magnetic brush arranged adjacent to the charge image carrier which is to be cleaned and means for supplying a toner to the magnetic brush to form a layer of toner thereon, and to form a thickening of the layer of toner on the magnetic brush in the region of contact of the layer on the magnetic brush with the charge image carrier.

The invention will now be described in more detail with reference to the accompanying drawings, which are not to scale and in which.

Figure 1:
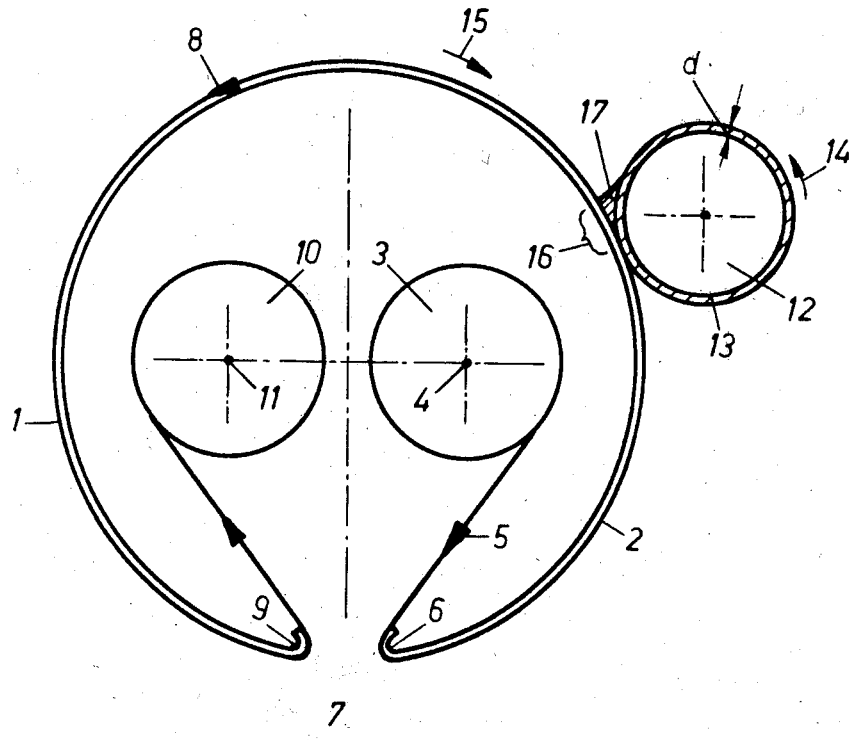
FIG. 1 is a diagrammatic representation of an apparatus according to the invention.

FIG. 1 shows a repeatedly usable charge image carrier 2 wrapped round a supporting drum 1. A supply roll 3 for the charge image carrier 2 is provided in the interior of the drum 1. This roll 3 is mounted to be rotatable about a shaft 4. The charge image carrier 2 runs off the supply roll 3 in the direction of the arrow 5 and passes over a rounded edge 6 on one side of a slot 7 in the surface of the drum 1 to emerge on the outside of the drum. The charge image carrier 2 lies in firm contact with the external surface of the drum 1 and is wrapped round it in the direction of the arrow 8.

It then passes over another rounded edge 9 on the other side of the slot 7 to re-enter the interior of the drum 1 which also contains a winding-on roller 10 rotatably mounted on a shaft 11. Driving and braking mechanisms (not shown in FIG. 1) are provided, whereby the charge image carrier 2 is tensioned over the drum 1 but is periodically moved stepwise from the supply roller 3 to the winding-on roller 10 according to the rate at which it wears down.

Apparatus usually used in electrostatic copying machines, such as a corona charging device, an exposure device, and an image transfer device, and the development and cleaning apparatus of the present invention are distributed about the periphery of the drum 1. For the sake of clarity, however, only a magnetic brush 12 of the latter apparatus has been shown in FIG. 1. This magnetic brush 12 is used both for developing a latent charge image formed on the charged image carrier 2 and for cleaning the charge image carrier 2 after the charge image which has been developed on it has been transferred to a final image support.

The toner layer 13 may move, for example, in the direction of the arrow 14. The drum 1 together with the charge image carrier 2 placed on it move in the direction of the arrow 15 both during production of the image and during cleaning. Whereas in the usual magnetic brushes for the development of latent electrostatic images on a charge image carrier the supply of toner is so adjusted that the brushes are covered with an approximately uniform layer of toner just sufficient to gently touch the surface of the charge carrier, the present invention uses a device which is described below to ensure that a definite excess of toner material is formed on the magnetic brush. The result of this is that the layer of toner 13 on the magnetic brush 12 forms a thickening 17, preferably in the form of a wedge, in a contact zone 16.

It has been found that such a magnetic brush provides an exceptionally high standard of development of a latent charge image on the charge image carrier. In addition, when such a layer 13 with a thickening 17 is formed on the magnetic brush 12 using a magnetic single component toner, one and the same magnetic brush can be used both for development and for excellent cleaning of the charge image support after transfer of the image. The construction is very simple. No special bias voltages need be applied to the magnetic brush to ensure removal of the residues of toner nor is it necessary to arrange or operate any particularly critical mechanical devices between the development stage and the cleaning stage.

The reserve of toner developing on the magnetic brush in the form of a wedge-shaped thickening 17 has the further advantage that a fresh supply of toner to the magnetic brush 12 need only be provided at long intervals.

All that is required for the formation of the preferably wedge-shaped thickening 17 is to ensure that a certain minimum excess of toner is always present on the magnetic brush, that is to say an excess over the minimum quantity required for forming a layer uniform thickness over the circumference of the magnetic brush.

It should be noted that if the wedge-shaped thickening 17 is destroyed, for example if the magnetic brush 12 is temporarily lifted from the charge image carrier 2 on the drum 1, the thickening 17 re-forms very quickly when the brush is moved back to the charge image carrier 2.

The same effect is also obtained if in the course of one cycle of image production the drum 1 carrying the charge image support rotates so that the slot 7 moves over the magnetic brush. As the slot 7 enters the region of the magnetic brush 12, the wedge-shaped thickening 17 briefly disappears but forms again within a short time as soon as the charge image carrier 2 again makes contact with it.

The size of wedge-shaped thickening 17 is relatively uncritical. The operational difficulties encountered with the usual magnetic brushes due to uneven contact with the charge image carrier are therefore effectively avoided.

If, for example, the magnetic brush 12 is lightly pressed against the surface of the drum 1, for example at the ends of the drum, with the aid of suitable guide devices, this ensures that the brush will always be arranged at the optimum distance and position in relation to the charge image carrier 2 and that, consequently, the wedge-shaped thickening 17 formed by the excess of toner in the layer 13 will always produce optimum results both for development of the image and for cleaning purposes.

Figure 2:
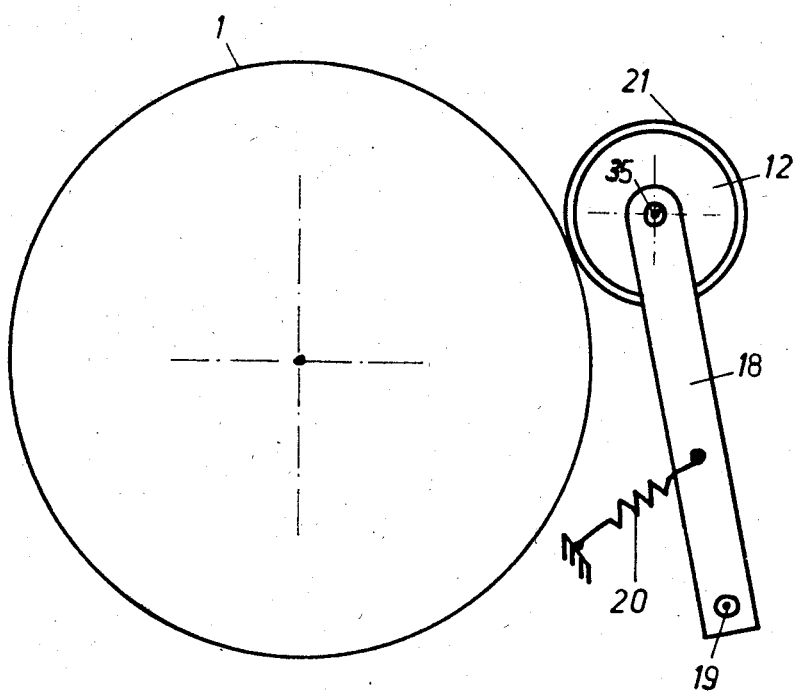
FIG. 2 shows an example of a support for a magnetic brush used in the apparatus of the invention.

FIG. 2 shows diagrammatically an example of an arrangement for supporting the magnetic brush 12 on the image support drum 1. The magnetic brush 12 is arranged laterally with respect to the drum 1, with its axis parallel to the axis of the drum. Each end of an axial shaft 35 of the magnetic brush 12 is mounted in its own, separate pivotal arm 18 which is mounted to be rotatable about a fixed pivot 19 and urged in the direction of the drum 1 by a tension spring 20. The magnetic brush 12 has a guide roller 21 mounted at each end of its cylindrical support. The diameter of each guide is slightly greater than the diameter of the cylindrical support of the brush 12. The guide rollers 21 mounted at each end of the magnetic brush are therefore held in rolling contact with the surface of the drum 1 by the action of the spring 20. Since the guide rollers 21 have a slightly greater diameter than the cylindrical support of the magnetic brush 12, a predetermined minimum gap is formed between the support of the magnetic brush and the charge image carrier 2 which lies on the surface of the drum 1. This gap determines the minimum thickness d (see FIG. 1) of the layer of toner 13 formed on the magnetic brush 12, provided a sufficient supply of toner is maintained.

Figure 3:
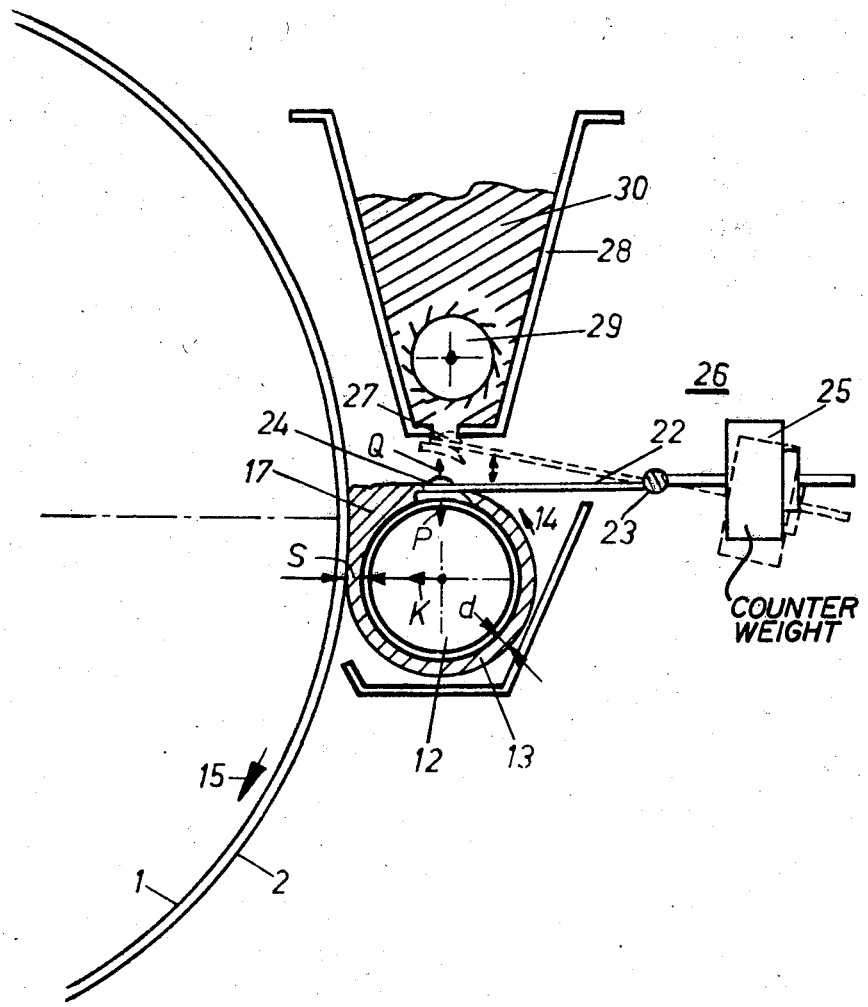
FIG. 3 shows on a larger scale the region of increased thickness of the layer of toner in one example of the invention.

FIG. 3 shows a portion of one embodiment of the apparatus according to the invention, in which sensing means, such as a sensing member, for example, a mechanical sensing feeler member, is provided for sensing the thickness of the layer of toner 13 to control the supply of toner and to provide and maintain the layer of toner 13 and the thickening 17 of the layer of toner 13 on the magnetic brush 12. For the sake of clarity, the thickness of the layer of toner 13 on the magnetic brush 12 is shown on a greatly enlarged scale. Due to the presence of a gap d, as shown in FIG. 1, the layer 13 has a thickness which is approximately equal to d. However, due to the deliberately produced excess of toner material on the magnetic brush, a wedge-shaped thickening 17 is formed.

The charge image carrier 2 is mounted on the drum 1. Seated on the inside of the magnetic brush 12 is a rotating magnetic system (not shown in FIG. 3) which causes the layer of toner 13 to revolve round the cylindrical support of the magnetic brush 12. The brush 12 is arranged with its axis parallel to the axis of the drum 1 but slightly displaceable in the radial direction with the aid of guide means not shown in FIG. 3. A force K produced, for example, by a spring (not shown), acts on the magnetic brush 12 to press it against the drum 1. With the layer 13 on the magnetic brush 12 revolving in the direction of the arrow 14 and the drum 1 with charge image carrier 2 on it rotating in the direction of the arrow 15, the wedge-shaped thickening 17 of the toner 13 is formed if there is an adequate supply of toner. The toner material is attracted towards the surface of the magnetic brush 12 by the magnetic system inside the brush. In the region where the toner material from the wedge-shaped thickening 17 enters the space between the magnetic brush 12 and the surface of the charge image carrier 2, a gap of width S is formed. The width S of this gap depends on the contact pressure of the magnetic brush and in a predetermined manner on the quantity of toner present in the thickening 17. The greater this quantity of toner, the greater will be the width S whereas if there is a significant reduction in the quantity of toner in the thickening 17, the width S also diminishes.

The thickness d of the layer of toner 13 on the magnetic brush 12 is therefore also affected by the width S which in turn depends upon the quantity of toner in the thickening 17.

A balance beam 22 is pivotally mounted on a fixed pivot 23. As its left hand end, this beam 22 carries a sensing feeler member plate 24 of non-magnetic material which extends over at least part of the length of the magnetic brush 12. The layer 13 which revolves round the magnetic brush 12 in the direction of the arrow 14 as a result of the magnetic system rotating inside the brush 12 flows over this plate 24, which is therefore pushed downwards with a force P both by the weight of the toner flowing over it and by the magnetic forces acting on the toner.

A force Q counteracting the force P is exerted on the beam 22 by a counter-weight 25 which is preferably adjustable. The balance beam 22, the pivot 23, the plate 24 and the counter weight 25 together constitute a mechanically operating sensing feeler member 26 which monitors the thickness d of the layer of toner 13. From what has been said above, it will be clear that this sensing member also monitors the quantity of toner stored in the thickening 17.

The member 26 can be adjusted by displacing the counter weight 25 so that if the quantity of toner in the thickening 17 falls below a certain critical value the member 26 will respond so that the beam 22 will move upwards on the left hand side.

The thicker or denser the layer of toner flowing over the plate 24, the greater will be the force P.

It has been found that the force P diminishes even if the layer 13 of the magnetic brush 12 is just sufficient for developing a latent charge image on the charge image carrier 2, but the size of the thickening 17 is at that state so far reduced that it is no longer sufficient for reliable cleaning of the charge image carrier 2 to remove residues of toner after a transfer step.

The above mentioned thickening 17 of the layer of toner on the magnetic brush thus provides reliable cleaning of the charge image support and improves development of the image, though development will take place quite adequately in the presence of only a slight thickening 17.

The response of the member 26 can be used to release a fresh supply of toner from a container, for example by opening of a flap 27 of a container 28 situated above the magnetic brush 12 and containing a reserve supply of toner. The flap 27 may be operated purely mechanically or electro-mechanically. A rotating delivery roller 29 inside the container 28 causes a portion of the toner supply 30 to be discharged from the bottom of the container when the flap 27 is open.

The quantity of toner on the magnetic brush 12 is thereby increased so that the quantity of toner in the thickening 17 is also increased and consequently the width S of the gap between the charge image carrier 2 and the magnetic brush 12 becomes wider. The thickness d of the layer of toner 13 on the magnetic brush 12 consequently also increases so that the layer 13 of toner can again exert sufficient force on the plate 24 to push it down against the magnetic brush. To return the plate 24, it is sufficient to push the left end of the beam 22 briefly downwards so that the plate 24 again dips into the layer of toner 13. This movement may be released, for example, by the toner dropping from the container 28. Alternatively, the beam 22 may be used to actuate an electrical contact which may, for example, cause an electro-magnetic drive to act with some delay on the beam 22 to return it to its operative position on the magnetic brush 12.

FIG. 3 shows a mechanically operating sensing member 26 but the size of the thickening 17 may also be monitored or sensed by an inductive or a capacitative device. For example, an induction coil may be arranged near the thickening 17 so that the magnetic toner mass in the thickening 17 alters the inductance of the coil by influencing its magnetic field. This change in inductance can be used to produce a control signal which is transmitted to a dosing device for supplying toner.

Instead of an inductive device, a capacitative sensing member may be used for monitoring the size of the thickening 17. For example, an electrode may be arranged near the thickening 17, the capacitance of the electrode depending on the size of the thickening 17.

We claim:

1. A process for developing a latent charge image on a repeatedly usable charge image carrier and for cleaning the repeatedly usable charge image carrier after transfer of the developed charge image therefrom, comprising developing the latent charge image on said carrier and cleaning the charge image carrier after transfer of the developed charge image therefrom by applying to the charge image carrier a wedge-shaped thickening of a layer of magnetic one-component toner formed on a magnetic brush during both developing and cleaning and maintaining said wedge-shaped thickening, said layer of toner formed on said brush having said thickening of the layer in the region of contact of the toner layer of the magnetic brush with the charge image carrier, and sensing the thickness of the wedge-shaped thickening of the layer of toner formed on said magnetic brush and controlling the supply of toner to the magnetic brush so as to provide the layer and maintain said thickening of the layer of toner in said region.

2. The process according to claim 1, wherein the thickness of the wedge-shaped thickening of the layer of toner formed on said magnetic brush is sensed by sensing means which controls means for supplying toner to the layer formed on said magnetic brush to provide and maintain said thickening of the layer of toner in said region.

3. The process according to claim 2, wherein said sensing means is mechanically operated and mechanically controls said means for supplying toner.

4. An apparatus for developing a latent charge image on a repeatedly usable charge image carrier and for cleaning the repeatedly usable charge image carrier after transfer of the developed charge image therefrom, comprising a single magnetic brush arranged adjacent to the charge image carrier, and means for supplying toner to the magnetic brush to form a layer of toner thereon, and to form a wedge-shaped thickening of the layer of toner on the magnetic brush in the region of contact of the layer on the magnetic brush with the charge image carrier, and means for sensing the thickness of the wedge-shaped thickening of the layer of toner formed on said magnetic brush and for controlling said means for supplying toner to said magnetic brush so as to provide and maintain said thickening of the layer of toner in said region.

5. Apparatus according to claim 4, wherein said means for sensing the thickness of the wedge-shaped thickening of the layer of toner formed on said magnetic brush and for controlling said means for supplying toner to said magnetic brush is a sensing member capable of sensing the thickness of the wedge-shaped thickening of the layer of toner on said brush.

6. Apparatus according to claim 5, wherein said sensing member is mechanically operated and mechanically controls said means for supplying toner to said magnetic brush so as to provide said layer and said thickening of the layer of toner in said region.

* * * * *